US006880463B2

(12) United States Patent
De Meulemeester et al.

(10) Patent No.: US 6,880,463 B2
(45) Date of Patent: Apr. 19, 2005

(54) COATING OF TONER IMAGES

(75) Inventors: Bendix De Meulemeester, Aartselaar (BE); Pierre Vennekens, Hove (BE)

(73) Assignee: Xeikon International, N.V., Lier (BE)

( * ) Notice: Subject to any disclaimer, the term of this patent is extended or adjusted under 35 U.S.C. 154(b) by 97 days.

(21) Appl. No.: 10/226,636

(22) Filed: Aug. 21, 2002

(65) Prior Publication Data

US 2003/0061986 A1 Apr. 3, 2003

Related U.S. Application Data

(60) Provisional application No. 60/314,761, filed on Aug. 24, 2001.

(51) Int. Cl.[7] ..... B45L 35/14

(52) U.S. Cl. ..... 101/488; 101/424.1; 399/341

(58) Field of Search ..... 101/421.1, 483, 101/487, 488, 176, 138, 135; 399/341, 342; 156/277, 278, 272.2; 428/336, 327

(56) References Cited

U.S. PATENT DOCUMENTS

| | | | | | |
|---|---|---|---|---|---|
| 3,905,849 | A | * | 9/1975 | Bomboire | 156/79 |
| 4,477,548 | A | | 10/1984 | Harasta et al. | 430/14 |
| 4,946,531 | A | * | 8/1990 | Crouch et al. | 156/242 |
| 5,232,812 | A | | 8/1993 | Morrison et al. | 430/124 |
| 5,316,608 | A | * | 5/1994 | Ocampo et al. | 156/230 |
| 5,461,470 | A | | 10/1995 | De Cock et al. | 355/326 |
| 5,506,671 | A | * | 4/1996 | Buts et al. | 399/39 |
| 5,552,898 | A | | 9/1996 | Deschuytere | 358/426 |
| 5,740,510 | A | | 4/1998 | Van den Bogaert et al. | 399/298 |
| 5,751,432 | A | * | 5/1998 | Gwaltney | 358/296 |
| 5,893,018 | A | | 4/1999 | De Bock et al. | 399/302 |
| 5,928,454 | A | * | 7/1999 | Nakadai et al. | 156/275.5 |
| 5,985,079 | A | * | 11/1999 | Ellison | 156/244.23 |
| 6,296,732 | B1 | * | 10/2001 | Enlow et al. | 156/209 |
| 6,397,030 | B1 | * | 5/2002 | Watanabe | 399/237 |
| 6,535,712 | B1 | * | 3/2003 | Richards | 399/341 |

FOREIGN PATENT DOCUMENTS

| | | |
|---|---|---|
| EP | 0 823670 | 2/1998 |
| FR | 1497189 | 10/1967 |
| GB | 1016472 | 1/1966 |

OTHER PUBLICATIONS

National Association for Printing Leadership, Operations & Technology Management Strategies for the Printing Industry, Issue 8, pp. 1–4, Mar. 2001.

Xeikon Digital Printing Association, Variable Data Printing, pp. 1–4, Jul. 19, 2001.

* cited by examiner

*Primary Examiner*—Anthony H. Nguyen
(74) *Attorney, Agent, or Firm*—Knobbe Martens Olson & Bear LLP

(57) ABSTRACT

Various embodiments of a system and method for forming coated toner images on a web are disclosed. The coating unit can be employed off-line or in-line with a digital printing system. The coating is applied on already fused toner images and is subsequently cured by means of UV radiation. The resulting coated fused toner images have a reduced sensitivity towards mechanical interaction, e.g., rubbing, and towards water, solvents and sunlight. In addition, they yield a smooth surface with an even tunable gloss, independent of the amount of superimposed toner layers.

31 Claims, 4 Drawing Sheets

COATING OF TONER IMAGES

RELATED APPLICATION

This application claims the benefit under 35 U.S.C. §119 (e) of U.S. Provisional Application No. 60/314,761, filed Aug. 24, 2001 and titled "COATING OF TONER IMAGES," which is hereby incorporated by reference in its entirety.

BACKGROUND OF THE INVENTION

1. Field of the Invention

The present invention generally relates to the formation of images with toner. More particularly, the present invention relates to an apparatus and a method to provide a UV-curable coating on toner images formed on a web.

2. Description of the Related Technology

The formation of toner images on a receptor material by means of an image reproduction system such as a printing or copying system is well known. In so-called direct image reproduction systems, such as direct electrostatic printing (DEP) systems, the toner is image-wise deposited on an image-receiving member. This image-receiving member can be the receptor material or an intermediate transfer member. In the latter case, the toner images are subsequently transferred to the receptor material. However, nowadays, in most image reproduction systems based on typical graphical processes including amongst others electrophotography, ionography and magnetography, instead of direct printing a latent image is formed corresponding to either the original to be copied or to digitized data describing an electronically available image. In electrophotography for instance, which is currently the most widespread, a charged latent image is formed on a pre-charged photosensitive member by image-wise exposure to light. This latent image is subsequently made visible on the image-forming member with developer at a development zone, the developer comprising, or consisting of, charged toner. The toner particles may constitute dry particulate matter. Alternatively, a wet liquid type developer may be used wherein the toner particles are dispersed in a solvent. In systems employing dry toner particles as developer, the development may be carried out by different methods as for instance "cascade," "magnetic brush," "powder cloud," "impression" or "transfer" development. After the development of the latent image, the developed image is transferred to a receptor material, directly or via one or more intermediate image-carrying members, where it may be permanently fused.

The toner images fused to the receptor material are to a certain extent vulnerable to physical interaction and can be e.g. scratched or otherwise damaged. Especially composite and/or multi-layer images, such as e.g. full color images are vulnerable due to the increased topography, e.g., the height differences within the toner image with respect to the surface of receptor material carrying the toner images. Besides the possible shortcomings of toner images fused on a receptor material such as e.g. lack of mechanical strength, unsatisfactory resistance to wear, and the possible negative impact over time of UV irradiation on the color rendering, there is also the look and feel of the toner images. Particularly for the reproduction of recorded images, such as e.g. photos, still images, greeting cards, covers, etc., the customer expects the look and feel of images produced by offset printing with appropriate finishing, where the printed images have a high brilliance, a smooth surface (e.g., without topography), an even gloss distribution and often a high gloss.

Protective overcoats on toner images and processes entailing the overcoating of toner images are known. For instance, U.S. Pat. No. 4,477,548 (assigned to Eastman Kodak Co) discloses radiation-curable coating compositions which can be used to provide protective overcoat layers. The overcoat layer is formed by coating a curable coating composition onto the toner image bearing substrate and curing the resulting coating to bond it to the substrate. The toner images may be formed by electrography. The curable coating composition comprises (a) either (i) a mixture of a siloxy-containing polycarbonol and an acrylated urethane or (ii) a siloxy-containing acrylated urethane, (b) a multifunctional acrylate, and, optionally (c) a free radical photoinitiator.

The published European patent application EP 0 823670 (assigned to Agfa-Gevaert) discloses an apparatus and method for applying a radiation curable composition on the image-side of a substrate bearing fused toner images. The means for applying the radiation curable composition can be rollers, wicks, sprays, screen printing, offset printing, and gravure rollers. In one embodiment, the means for fusing the toner particles and the means for curing the radiation curable composition are mounted in said apparatus directly adjacent to each other so that the curing proceeds on the warm curable composition.

Although known apparatus and processes may be suitable for their intended purposes, e.g., primarily to provide a protective overcoat on the toner images primarily for protection against mechanical interaction, they give unsatisfactory results with respect to the compensation for any possible topography in the toner images, the controllability of gloss, the gloss uniformity and the thickness control of the overcoat.

SUMMARY OF CERTAIN INVENTIVE ASPECTS

One aspect of the present invention includes a coating engine for forming a glossy surface on a print media, the coating engine comprising a digital printing unit for superimposing a plurality of images on said print media, an application unit for coating said print media with a coating composition, a UV transparent film and a UV lamp for curing the coating composition on said print media, creating said glossy surface, wherein said UV lamp irradiates said print media via said UV transparent film.

This additionally comprises the coating engine wherein the coating composition not containing any solvents and is dry mass. This additionally comprises the coating engine wherein the thickness of said UV transparent film is in the range from about 1–250 microns. This additionally comprises the coating engine wherein the thickness of said UV transparent film is at least about 40 microns. This additionally comprises the coating engine wherein the UV transparent film has a thickness of about 100 microns. This additionally comprises the coating engine wherein the UV transparent film has a thickness of between about 40 microns and about 100 microns. This additionally comprises the coating engine wherein a topographical difference is defined as the difference between the height of the highest particle on the cured print media and the height of the lowest particle on the cured print media. This additionally comprises the coating engine wherein said cured print media has a topographical difference of less than about 5 microns. This additionally comprises the coating engine wherein the smoothness of the UV transparent film determines the gloss level of the glossy surface, and wherein said gloss level is related to the smoothness of the UV transparent film. This additionally comprises the coating engine wherein the thickness of the UV transparent film determines the thickness of said glossy surface, and wherein the thickness of the selected UV transparent film is related to the topography of said cured print media.

Another aspect of the present invention includes an apparatus for forming a succession of images on a web having a first side, comprising a digital printing unit for forming a succession of fused toner images on said first side of said web, an application unit for applying a UV-curable coating composition on said fused toner images on said first side of said web, a UV transparent film contacting said first side of said web in a contact zone such that said coating composition is enclosed between said first side of said web and said UV transparent film and a UV curing unit for irradiating said coating composition in said contact zone through said UV transparent film while said web is conveyed through said contact zone substantially simultaneously with said UV transparent film.

This additionally comprises the apparatus wherein the thickness of said UV transparent film is in the range from about 1–250 microns. This additionally comprises the apparatus wherein said UV transparent film has a thickness of at least 40 microns. This additionally comprises the apparatus wherein said UV transparent film has a thickness of about 100 microns. This additionally comprises the apparatus wherein the UV transparent film has a thickness of between about 40 microns and about 100 microns. This additionally comprises the apparatus wherein said UV transparent film is a material selected from the group containing polyesters, polyethylene, polypropylene, cellophane and polyethylene terephtalate. This additionally comprises a cooling unit for actively cooling said UV curing unit. This additionally comprises the apparatus wherein said digital printing unit is a single pass duplex printing unit.

An additional aspect of the invention includes a method of forming a succession of images on a web comprising feeding a web through a digital printing unit to thereby form a succession of fused toner images on a first side of said web, applying a UV-curable coating composition on said first side of said web carrying said fused toner images, contacting said first side of said web with a UV transparent film in a contact zone, such that in said contact zone said UV-curable coating composition is enclosed between said UV transparent film and said first side of said web and curing said UV-curable coating composition by UV-irradiating said UV-curable coating composition through said UV transparent film in said contact zone.

This additionally comprises the method wherein the curing is followed by disengaging said UV transparent film from said web. This additionally comprises the method wherein fused toner images are also formed on a second side of said web. This additionally comprises the method wherein prior to applying the coating composition, said first side of said web comprises an amount of release agent corresponding to 0.1 mg of release agent per printed side A4 or less.

An additional aspect of the invention includes a method of forming a succession of digital images including recorded images on a web comprising converting image data representing a recorded image into a printable bitmap and forwarding said printable bitmap to a digital printing unit, feeding a web through said digital printing unit to thereby form a succession of fused toner images on a first side of said web, applying a radiation-curable coating composition on said first side of said web and curing said radiation-curable coating composition.

This additionally comprises the method wherein, prior to converting said image data representing a recorded image into a printable bitmap, said image data is combined with customer data. This additionally comprises the method wherein said image data combined with said customer data is converted into a full-tone binary bitmap, a contone bitmap, and a bitmask for indicating whether each corresponding pixel belongs to said full-tone binary bitmap or said contone bitmap. This additionally comprises the method wherein said image data combined with said customer data is converted into a full-tone binary bitmap, a contone bitmap, and a bitmask for indicating whether each corresponding pixel belongs to said full-tone binary bitmap or said contone bitmap. This additionally comprises the method wherein said image data representing said recorded images is printed on said first side of said web while at least part of said customer data is printed on a second opposite side of said web. This additionally comprises the method wherein the coating composition is a UV-curable coating composition, which is cured by means of UV irradiation. This additionally comprises the method wherein the steps of applying and curing the radiation curable coating composition are executed off-line.

An additional aspect of the invention includes a method of forming a succession of digital images including recorded images on a web comprising the steps of converting a bitmap representing a recorded image into a first printable bitmap, converting customer data into a second printable bitmap, forwarding said first printable bitmap and said second printable bitmap to a digital printing unit, forming a combined bitmap by combining said first printable bitmap and said second printable bitmap, feeding a web through a digital printing unit to thereby create a succession of fused toner images representative of said combined bitmap on a first side of said web, applying a radiation-curable coating composition on said first side of said web and curing said radiation-curable coating composition so as to create a glossy surface on said first side of said web.

This additionally comprises the method wherein said bitmap representing a recorded image is converted into a full-tone binary bitmap, a contone bitmap, and a bitmask for indicating whether each corresponding pixel belongs to said full-tone binary bitmap or said contone bitmap. This additionally comprises the method wherein said customer data is converted into a full-tone binary bitmap, a contone bitmap, and a bitmask for indicating whether each corresponding pixel belongs to said full-tone binary bitmap or said contone bitmap. This additionally comprises the method wherein said image data representing said recorded images is printed on said first side of said web while at least part of said customer data is printed on a second opposite side of said web. This additionally comprises the method wherein a topographical height difference between a highest particle and a lowest particle on said first side of said web is less than 5 microns. This additionally comprises the method wherein said curing step further comprises placing a UV transparent film between said first side of said web and a UV lamp, and irradiating said first side of said web with UV radiation from said UV lamp via said UV transparent film.

This additionally comprises the method wherein the thickness of said UV transparent film is in the range from about 1–250 microns. This additionally comprises the method wherein the thickness of said UV transparent film is at least about 40 microns. This additionally comprises the method wherein the UV transparent film has a thickness of about 100 microns. This additionally comprises the method wherein the UV transparent film has a thickness of between about 40 microns and about 100 microns. This additionally comprises the method wherein the smoothness of said UV transparent film determines a gloss level of said glossy web surface, and wherein said gloss level is proportional to the smoothness of the UV transparent film. This additionally comprises the method wherein the thickness of the UV transparent film determines the thickness of said glossy surface, and wherein the thickness of the UV transparent film is related to the thickness of said glossy surface.

A further aspect of the invention includes a photograph created by the process of forming a succession of images on a web comprising feeding a web through a digital printing unit to thereby form a succession of fused toner images on a first side of said web, applying a UV-curable coating composition on said first side of said web carrying said fused toner images, contacting said first side of said web with a UV transparent film in a contact zone, such that in said contact zone said UV-curable coating composition is enclosed between said UV transparent film and said first side of said web, and curing said UV-curable coating composition by UV-irradiating said UV-curable coating composition through said UV transparent film in said contact zone.

This additionally comprises the photograph wherein the curing is followed by disengaging said UV transparent film from said web. This additionally comprises the photograph wherein fused toner images are also formed on a second side of said web. This additionally comprises the photograph wherein prior to applying the coating composition, said first side of said web comprises an amount of release agent corresponding to 0.1 mg of release agent per printed side A4 or less.

An additional aspect of the invention includes a method of forming an image on a web comprising converting image data representing a recorded image into a printable bitmap and forwarding said printable bitmap to a digital printing unit, feeding a web through said digital printing unit to thereby form a fused toner image on a first side of said web, coating the image off-line in a web-fed coating engine with a UV-curable coating composition on said first side of said web.

This additionally comprises the method wherein coating the image off-line comprises applying the UV-curable coating composition, contacting said first side of said web with a UV transparent film in a contact zone such that said UV-curable coating composition is enclosed between said first side of said web and said UV transparent film, irradiating said UV transparent film in said contact zone, and disengaging said UV transparent film from said web. This additionally comprises the method wherein coating the image off-line further comprises winding the web. This additionally comprises the method wherein coating the image off-line further comprises cutting the images directly on-line.

DETAILED DESCRIPTION OF CERTAIN EMBODIMENTS

According to one embodiment of the invention a digital printing system is disclosed in-line with a coating unit for forming coated toner images on a web which are not sensitive to mechanical interaction, e.g. rubbing, have a reduced sensitivity towards solvents and sunlight, and yield a smooth surface with even gloss independent of the amount of superimposed toner layers. The web can be a web of receptor material or the web can be a substrate whereto sheets of receptor material are temporarily attached. Typical receptor materials include paper, films, label stock, cardboard etc. The digital printing system for forming toner images may be a direct printing system such as e.g. direct electrostatic printing (DEP) system, wherein the toner is image-wise deposited on an image-receiving member. This image receiving member can be the receptor material or an intermediate transfer member. In the latter case the toner images are subsequently transferred to the receptor material.

Figure 1:
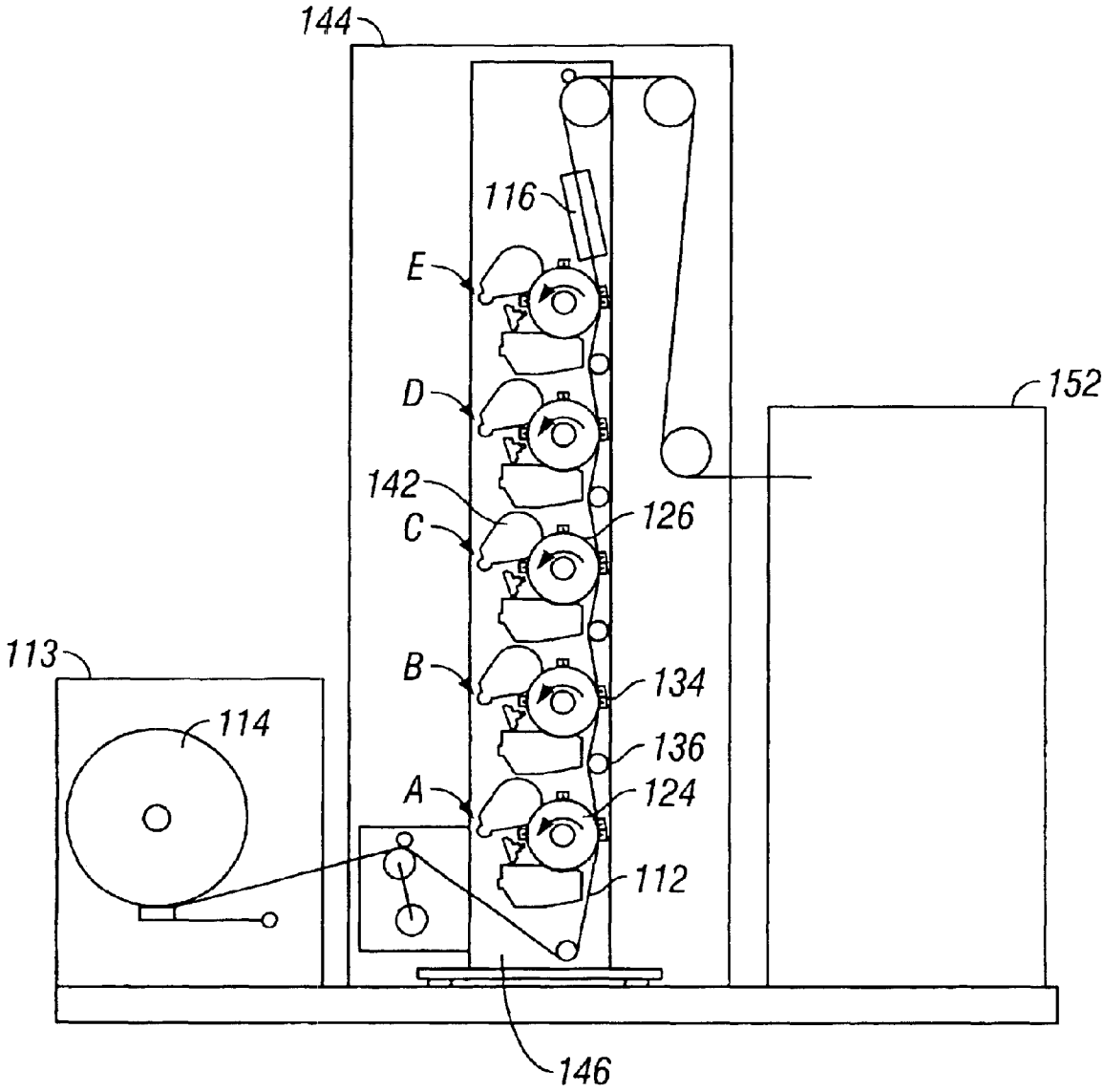
FIG. 1 depicts a digital printing system according to an embodiment of the invention.

Also other printing systems, e.g. based on electrophotography, or ionography or magnetography, can be used. In such systems instead of direct printing a latent image is formed corresponding to either the original to be copied or to digitized data describing an electronically available image. This latent image is developed, transferred and fused to a receptor material, directly or via one or more intermediate transfer members. As an example, in FIG. 1 a schematic representation of an electrophotographic color printer is depicted. This printer has a supply station 113 in which a roll 114 of web material 112 is housed. The web 112 is conveyed into a tower-like printer housing 144 in which a support column 146 is provided housing at least four printing stations A–D, e.g. black, yellow, magenta and cyan. In the figure, an extra printing station E is provided, allowing to optionally add an additional color.

Figure 2:
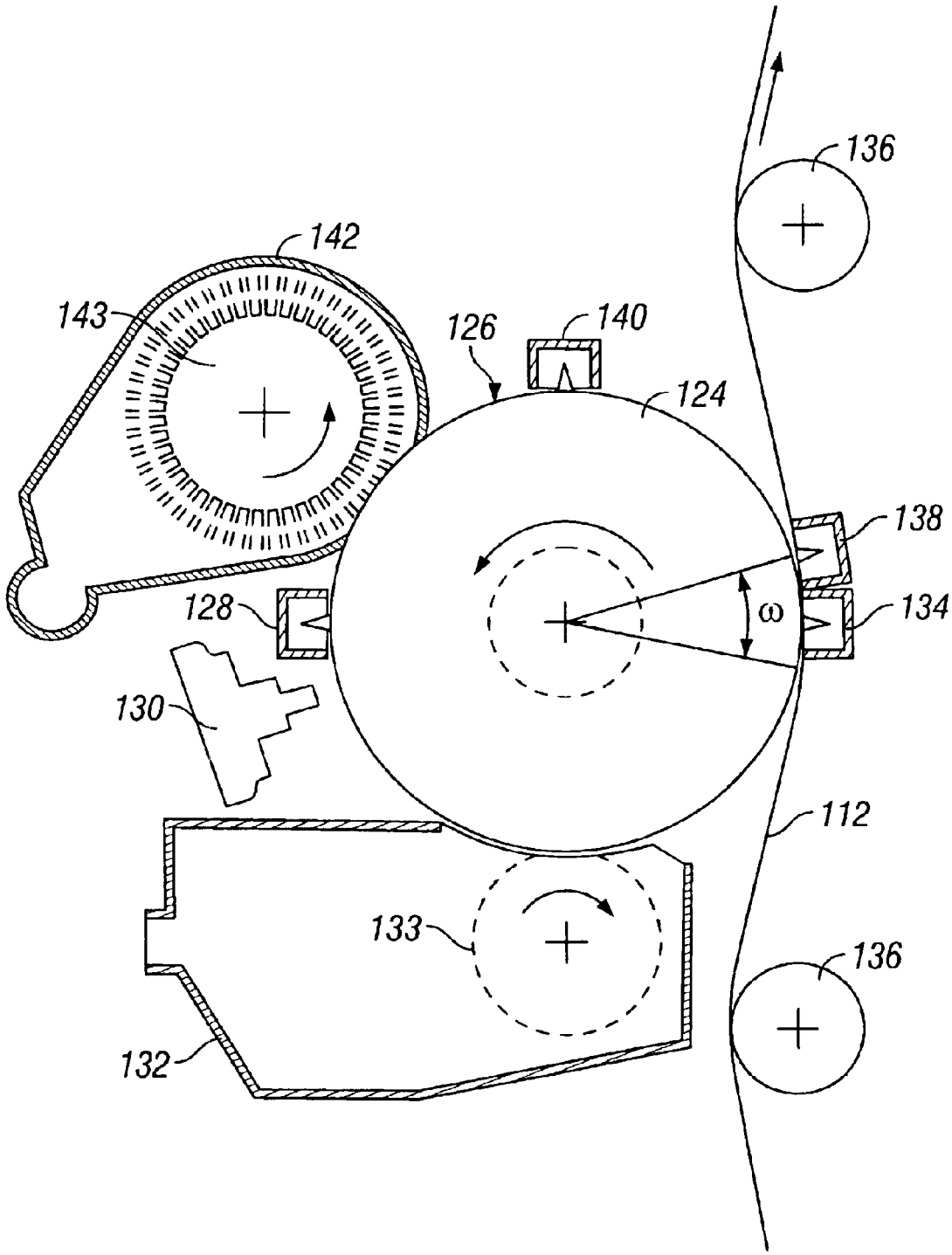
FIG. 2 depicts an image-forming station being part of digital printing system according to an embodiment of the invention.
Figure 3:
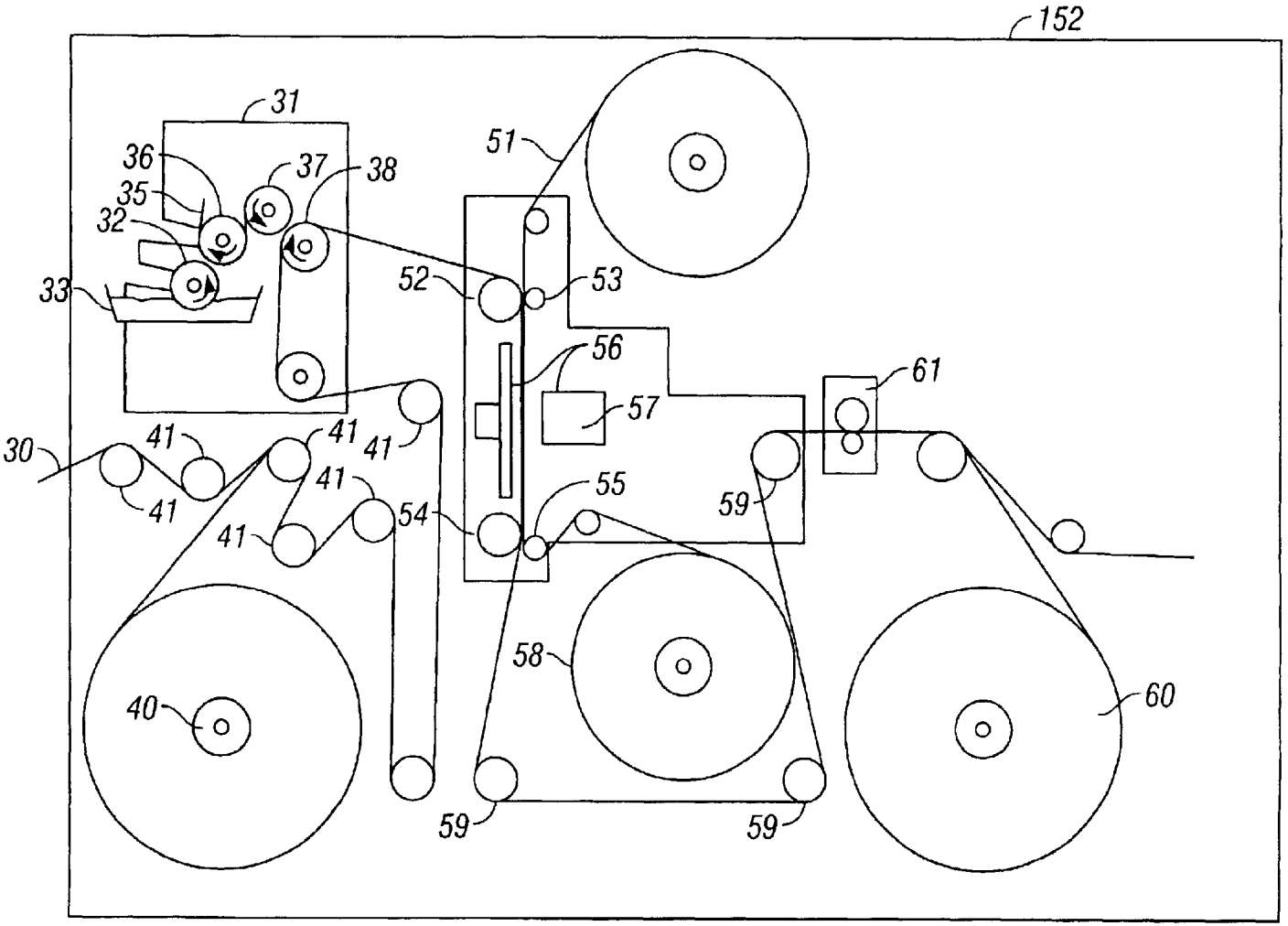
FIG. 3 depicts a radiation curable coating unit according to an embodiment of the invention.

As shown in FIG. 2, each printing station comprises a cylindrical drum 124 having a photoconductive outer surface 126. The drum acts both as an image-delivering member and as an image-forming member. Circumferentially arranged around the drum 124 there is a main charge generating device 128 capable of charging the drum surface to a high potential of about −600 volts (V), e.g., the dark potential, an exposure device 130 will image-wise discharge (e.g. to a potential of about −250 V) the surface 126 to thereby form a latent image. This latent image is developed on the drum by the developer station 132 by contacting the drum with a magnet brush of a two-component developer of non-permanently magnetized magnetic carrier beads having dry toner particles adhering triboelectrically thereto formed on the surface of a magnet roller 133. Negatively charged toner particles are attracted to the exposed (discharged) areas of the photoconductor.

After development, the toner image on the drum surface is transferred to the moving web 112 by a transfer corona device 134 which generates an attractive electrical field for the negatively charged toner particles. This transfer corona together with the guiding rollers 136 establishes also a strong adherent contact between the web and the drum over an angle of about 15 degrees which causes the latter to be rotated in synchronism with the movement of the web 112 and urges the toner particles into firm contact with the surface of the web 112. A web discharge corona 138 is provided to establish a controlled release of the web. Thereafter the drum surface is pre-charged by a charge generating device 140 to a potential between 0 and −600 V both for facilitating the charging by the main charge generating device and to facilitate the removal of residual images on the drum surface by a cleaning unit 142. The cleaning unit 142 includes an adjustably mounted fibrous-like cleaning brush 143, the position of which can be adjusted towards or away from the drum surface to ensure optimum cleaning. The cleaning brush 143 is grounded or subject to such a potential with respect to the drum as to attract the residual developer particles away from the drum surface.

The rotatable cleaning brush 143 which is driven to rotate in a sense the same as to that of the drum 124 and at a peripheral speed of, for example, twice the peripheral speed of the drum surface. The developer station 132 includes a magnetic roller with a magnetic brush formed thereon 133, which rotates in a sense opposite to that of the drum 124. The resultant torque applied to the drum by the rotating developing brush 133 and the counter-rotating cleaning brush 143 is adjusted to be close to zero, thereby ensuring that the only torque applied to the drum is derived from the adherent force between the drum and the web.

After a first image of a first color is formed and transferred to the web in a first print station, the web passes successively the other print stations where images of other colors are formed and transferred in register to thereby form a registered multi-color image on the web. After leaving the final print station E, the image on the web is fused by means of the image fusing station 116 and is rewound or fed to an in-line finishing unit 152 such as the coating unit according to the present invention or alternatively a cutting station with an optional stacker if desired. Instead of the simplex printing system described herein enabling printing on one side of the web, a duplex printing system enabling printing both on the obverse and the reverse side of the web may be used. Such a system is disclosed in U.S. Pat. No. 5,461,470 (assigned to Xeikon) which is hereby incorporated by reference in its entirety. The duplex system disclosed in U.S. Pat. No. 5,461,470 (also assigned to Xeikon) is of particular interest as this is a single pass duplex printing system which enables printing on both sides of a receptor material without reversal of the receptor material. Other examples of printing systems which may be employed are the systems disclosed in U.S. Pat. Nos. 5,740,510 and 5,893,018 (both assigned to Xeikon), which are hereby incorporated by reference in their entireties.

After a succession of fused toner images is formed by a digital printing unit on the web 30, the web 30 is forwarded using guiding rollers 41 to an application unit 31 for applying a radiation curable coating composition on a side of the web carrying fused images. Alternatively the web is rewound and potentially after storage introduced in the coating unit according to the present invention where the web is fed from an unwinder 40 towards an application unit 31 for applying a radiation curable coating composition on the fused toner images formed on the web 30. The fused toner images may be substantially dry toner images, for example the fused images formed using the digital printing system shown in FIG. 1. A substantially dry fused image is an image formed using a dry type developer instead of a liquid one and which has preferably not been exposed to a release agent, e.g., oil, during its formation and fusing process or has been exposed to a very limited amount of release agent, e.g., being an amount corresponding to 0.1 milligram (mg) per printed side A4 or less.

One of the advantages of such substantially dry fused images is that adhesion problems with subsequently applied coating layers can be avoided. When the fused toner images are formed with a digital reproduction system employing a toner dispersed in a liquid, the web bearing the fused toner images has to pass through a drying station first before the coating can be applied and cured in order to avoid adhesion problems. The means for applying the coating composition can be rollers, wicks, sprays, screen printing, offset printing, and gravure rollers. In one embodiment, analogous to flexography, an application system is used comprising three rollers. A first rotatable roller 32, e.g., a supply roller, is partially immersed in a container 33 containing the coating composition. The supply roller has a rubber covering. The harder the durometer of the rubber covering on the roll, the less coating composition the roller will transfer. The hardness is typically from 60 to 90 Durometer Shore A.

The coating composition present on the surface of the supply roller is at least partially transferred to a second rotatable roller, e.g., a metering roller, contacting the supply roller. The metering roller may be engraved with cells that meter and transfer the coating composition. To assist in the metering, a doctor blade 35 may be provided. In operation, the metering roller rotates in a direction opposite to the rotation direction of the supply roller. The third roller 37, e.g., the application roller, applies the coating composition to the side of the web carrying the fused toner images to be coated. In operation, this application roller contacting the metering roller and rotating in a direction opposite to the rotation direction of the metering roller transfers the coating composition to the fused toner image bearing side of the web in a contact zone defined by establishing pressure contact between the application roller and a backing roller 38 while the web passes in between.

Useful radiation curable coating compositions are disclosed in U.S. Pat. No. 4,477,548 and EP 0 823670, which are hereby incorporated by reference. The coating is preferably transparent in the visible spectrum. The radiation curing may be performed by means of UV radiation. In the latter case, a photo-initiator may be present in the radiation curable coating composition. Particularly useful coatings are solutions composed of monomers and photo-initiators, which do not contain any solvents. By means of UV radiation, the photo-initiators will work as a catalyst for the polymerization of the monomers. The polymerization will turn the solution into a completely fixed plastic film. Since these coating products do not contain any solvents and are 100% dry mass, their use is extremely environmental friendly. In an example UVD00100-405 (Akzo Nobel) was used as a coating composition. This coating is particularly suited for an absorbent receptor material. In case of a coated receptor material, UVF00106-405 (Akzo Nobel) may be used. Typically an amount from 5 to 50 g per square meter or from 9 to 15 g per square meter of coating composition is applied to the side of the web bearing the fused toner images to be coated.

After the coating composition is applied to the web 30, the web 30 is guided towards a zone where contact is established between a UV transparent film 51 and the web 30 such that the coating composition is enclosed in-between. The contact zone can be defined by two roller pairs, one 52, 53 spaced from the other 54, 55. The beginning of the contact zone is defined by the first roller pair comprising a roller 52 backing the web and a roller 53 backing the UV transparent film. The UV transparent film is fed from the unwinder 51 to the first roller pair. Both film and web are guided in-between the rollers of the first roller pair while establishing a pressure contact between the rollers. Subsequently the film and the web enclosing the coating are advanced together, while curing the coating, to the second roller pair 54, 55 determining the end of the contact zone. Hereafter the film is disengaged from the web bearing the cured coating. The curing proceeds by means of a UV curing unit 56 comprising a UV lamp 57 being positioned such as to irradiate the coating composition in said contact zone through said film while said web with said fused toner images thereon is conveyed through said contact zone simultaneously with said film. A cooling unit may be provided to actively cool the UV curing unit.

The film, which can be multiply reused, may be composed of a UV transparent material as for instance a material selected from the group containing polyesters, polyethylene, polypropylene, cellophane, and polyethylene terephtalate. One of the advantages of this configuration is that one can control the surface smoothness of the final coated images. This surface smoothness may be in a first instance adversely affected by the metering roller, which as stated above may be engraved. However, the structure of the UV transparent film surface for contacting the coating composition determines the maximum achievable gloss of the final image as the coating is flattened out in the contact zone between the web and the film. The smoother the film, the higher the gloss of the final images. The achieved gloss levels are comparable with the gloss levels of glossy traditional photos.

The film may have a thickness from 1 micrometers ($\mu$m) to 250 $\mu$m. An example of such a film is Trespaphan NNA20 (Hoechst), which is a 20 $\mu$m thick untreated polypropylene film. However, it has been observed that a Trespaphan NNA20 film does not compensate satisfactorily for the topography, e.g., the height differences within the toner image with respect to the surface of receptor material carrying the toner images, present in fused dry toner images. In uncoated composite and/or multi-layer images, such as full color images, and particularly when using a dry type developer, it is not unusual to have fused toner piles of about 15 $\mu$m in the high density regions of these images. As a result, at the edges of such images a possible height difference of about 15 $\mu$m is to be compensated for. It has been found that this can be overcome using a UV transparent film of at least 40 $\mu$m thickness. Tests performed with a MELINEX® 401 polyester film (Dupont) with a thickness of 100 $\mu$m as the UV transparent film resulted in a very smooth coating having substantially no topography. It is clear that the topography in the uncoated toner images depends on the toner particle size which is typically between 5 and 8 $\mu$m in case of dry toner, but which can be significantly smaller, e.g., between 2 and 5 $\mu$m in case of a liquid toner. Therefore, in one embodiment of a toner, liquid or dry, with a particle size below 5 $\mu$m, a UV transparent film having a thickness of at least 20 $\mu$m can be used.

The UV transparent film, after being disengaged from the web, is rewound by a rewinding unit 58. The web is guided over guiding rollers 59 towards a rewinder 60, or a cutting unit (not shown) optionally followed by a stacker (also not shown). Optionally, a slicing unit 61 may be provided to slice the web in the longitudinal direction.

For coating both sides of a web one can after coating of the first side of the web, which can be done either off-line or on-line, revert and rewind the web and reintroduce the web off-line into the coating unit to coat the uncoated side of the web. Alternatively, one may also opt for a complete duplex in-line configuration comprising a duplex digital printer forming fused toner images on both sides of the web, a first in-line coating unit for coating a first side of the web and a second in-line coating unit for coating a second opposite side of the web. In the latter example, the web is preferably reverted between the first and the second coating unit.

Embodiments of the apparatus and method according to the present invention are particularly useful for forming a succession of digital images including recorded images on a web. Recorded images are digital contone images as, e.g., generated by a scanner, a digital camera or a video camera, which are usually in bitmap or encapsulated bitmap format. In case of multi-color images, the colors are already separated usually in RGB or CMYK, meaning that each image is represented by multiple bitmaps, one for each color. These bitmaps may already be compressed. As recorded images are contone images, usually a lossy compression format such as JPEG ("Joint Photographic Experts Group") is used. The apparatus and method of the present invention enables to convert and process these files into printable bitmaps in a flexible and time-efficient way. The converting and processing may include image compression and decompression, conversion from RGB to CMYK, image enlargement, reduction, clipping, mirroring, rotation, imposition, resolution scaling and screening.

Although certain embodiments of the system and method of the present invention are particularly suited for reproducing recorded images, in other embodiments customer data, including text and artificially created images, can be reproduced. In particular, one method of the present invention is highly suited to combine, e.g., a sequence of recorded images with customer data. The customer data may contain, e.g., dates, logos, advertising, barcodes and customer specific data used for retrieval and tracking purposes of the recorded images. Typical formats used for customer data are PDF ("Portable Document Format" from Adobe) and XML ("Extensible Markup language" from the World-Wide Web Consortium). It is a further advantage of certain embodiments of the present invention to combine the customer data with the recorded image either on the same side of the web or on opposite sides of the web. In the former case, the customer data will be coated together with the recorded images. In the latter case, a duplex digital reproduction system may be utilized.

Customer data combined with the recorded images can be processed on the fly by the raster image processor (RIP) or can be pre-processed by the RIP and combined in real time, after retrieval from the memory, with the recorded images. The customer data and recorded images are converted by the RIP into a printable bitmap format.

Further according to certain embodiments of the present invention, a method is disclosed comprising the steps of: combining image data representing a recorded image with customer data; converting said image data combined with said customer data into a printable bitmap; forwarding said printable bitmap to a digital printing unit; feeding a web from a web supply unit through said digital printing unit to thereby form from said printable bitmaps a succession of fused toner images on a side of said web; applying a UV-curable coating composition on the side of the web carrying said fused toner images; and curing said UV-curable coating composition.

Figure 4:
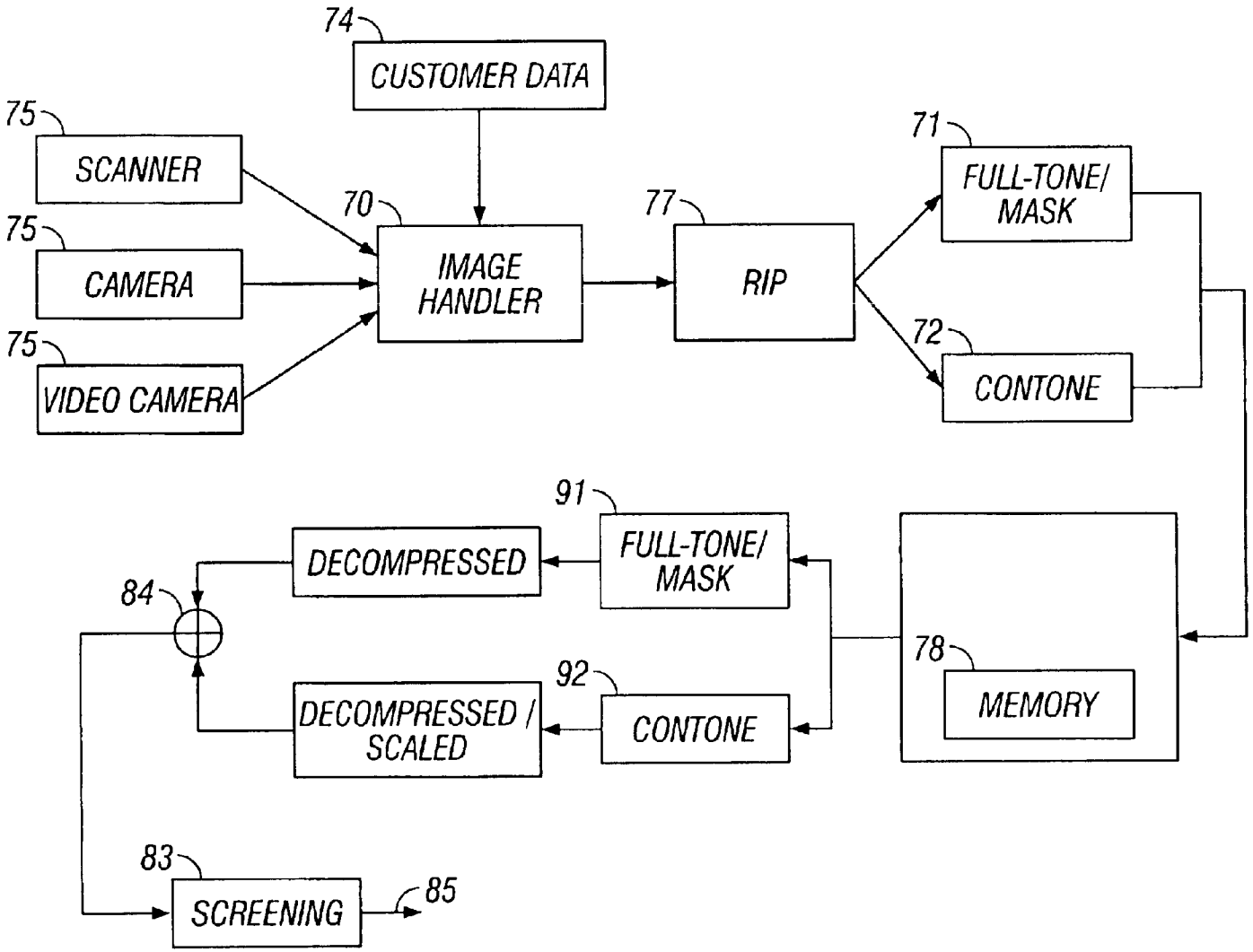
FIG. 4 depicts a schematic representation for printing recorded images according to an embodiment of the invention.

Each of the bitmaps representing a recorded image 75 (see FIG. 4) is combined by the image handler 70 with customer data 74. The combined data is converted by a raster image processor into a full-tone binary bitmap 71, a contone bitmap 72, and a bitmask 71 for indicating whether each corresponding pixel belongs to said full-tone binary bitmap or said contone bitmap. These respective bitmaps may be temporarily stored in the memory. Reference is also made to U.S. Pat. No. 5,552,898 (assigned both to Xeikon and Agfa-Gevaert), which is hereby incorporated in its entirety, in which input commands defined in a page description language are converted by the raster image processor into an a full-tone binary bitmap, a second bitmap, and a bitmask. The conversion step may include a decompression step and a compression step. This conversion step may also include a conversion from RGB to CMYK. When the printing unit requires the data, the full-tone bitmap 91, the contone bitmap 92, and the bitmask 91 are forwarded to the printing unit. The printing unit may be, for example, the simplex printer described in FIG. 1 or more preferably the duplex version thereof. These printers are commercially available as OCP 320S, OCP 500SP and the single pass duplex versions OCP 3200, OCP 5000, all of them manufactured by Xeikon. The 320's are full color web fed printers having a web width of about 32 centimeters (cm), while the 500's have a web width of about 50 cm. These printers are 600 dots per inch (dpi) multilevel systems, typically up to 4 bits per spot, capable of handling images having a length up to 11 meters (m). An example of a recorded image is for instance a full-color contone image scanned typically at a resolution of 300 dpi with 8 bits per spot (bps).

The decompressed CYMK bitmaps representing that image are each converted into a binary full-tone bitmap, a contone bitmap and a bitmask. Further image handling, such as clipping, imposition, rotation, etc., is performed by the image handler 70, where a page element or even an entire page is composed. Thereafter the generated bitmaps and bitmasks may be compressed and (temporarily) stored in a memory 78. The contone bitmaps 72 may be compressed using a lossy compression format, such as JPEG, while the full-tone bitmap and the bitmask 71 are typically compressed, separately or together, using a lossless compression technique based on run length encoding. The bitmaps may be sent to the printing unit. When required, the contone bitmaps 92 as well as the full-tone bitmaps and the bitmask 91 are sent to the printing units where they are decompressed, when in compressed format. The contone bitmaps are resolution-scaled and subsequently combined 84 with the binary full-tone bitmaps using the bitmask. The combined bitmaps may be screened 83 at frequency of 170 lines per inch (lpi), but to obtain photographic quality 212 lpi is preferred. As a result 600 dpi, 4 bps printable bitmaps are generated for each color 85. The printing unit forms a succession of substantially dry fused full color toner images on at least one side of the web. Instead of full color images, monochrome images may also be formed. The web is typically advanced at a speed between 5 and 50 centimeters per second (cm/s). In the digital color printer (DCP) this is typically 15 cm/s. The web carrying these images can be rewound and temporarily stored for coating later. However, in one embodiment the web is advanced directly to an in-line coating unit. In this coating unit a radiation curable is applied which is subsequently cured. In one embodiment, a UV-curable coating is applied. The curing is executed by means of a UV radiation source. This UV radiation source may be actively cooled.

The various embodiments of the present invention is highly applicable for the forming of high quality images for, e.g., posters, greeting cards, photos, etc. By the use of electrophotography combined with a UV curable coating, the use of silver halide photopaper can be avoided having the advantage of a reduced cost per print and allowing for a higher light fastness. Moreover the coated fused toner images have the advantage of an increased resistance to water, solvents, and mechanical interaction compared to a traditional analogue photofinishing process and uncoated fused toner images. By contacting the coated web with a UV-transparent film prior to curing, the surface smoothness and gloss of the coated images can be controlled by selecting the appropriate film composition and film surface smoothness. Furthermore, by using in the coating process a UV-transparent film having a thickness of at least 40 $\mu$m, any topography in the fused toner images can be compensated for. Therefore, by applying the method of the present invention, a succession of photos can be printed of virtually arbitrary dimensions having a photographic look and feel, but compared to analogue photographs, with improved quality and at reduced cost. Moreover, customer data can be printed together with the recorded images at a first side of the web, or when using a digital duplex printer at the customer data may be printed at the second opposite side of the web or on both sides of the web. In the case of duplex printing, a single pass duplex printer may be used.

What is claimed is:

1. A coating engine for forming a glossy surface on a print media, the coating engine comprising:

a digital printing unit for superimposing a plurality of images on said print media;

an application unit for coating said print media with a coating composition;

a UV transparent film for releasably contacting said print media; and a UV lamp for curing the coating composition on said print media, creating said glossy surface on said print media, wherein said UV lamp irradiates said print media via said UV transparent film.

2. The coating engine of claim 1, wherein said coating composition does not contain any solvents and is dry mass.

3. The coating engine of claim 1, wherein the thickness of said UV transparent film is in the range from about 1–250 microns.

4. The coating engine of claim 1, wherein the thickness of said UV transparent film is at least about 40 microns.

5. The coating engine of claim 1, wherein the UV transparent film has a thickness of about 100 microns.

6. The coating engine of claim 1, wherein the UV transparent film has a thickness of between about 40 microns and about 100 microns.

7. The coating engine of claim 1, wherein a topographical difference is defined as the difference between the height of the highest particle on the cured print media and the height of the lowest particle on the cured print media.

8. The coating engine of claim 7, wherein said cured print media has a topographical difference of less than about 5 microns.

9. The coating engine of claim 1, wherein the smoothness of the UV transparent film determines the gloss level of the glossy surface, and wherein said gloss level is related to the smoothness of the UV transparent film.

10. The coating engine of claim 1, wherein the thickness of the UV transparent film determines the thickness of said glossy surface, and wherein the thickness of the selected UV transparent film is related to the topography of said cured print media.

11. The coating engine of claim 1, further comprising a rewinding unit for rewinding said UV transparent film.

12. The coating engine of claim 1, further comprising a slicing unit for slicing said print media.

13. An apparatus for forming a succession of images on a web having a first side, comprising:

a digital printing unit for forming a succession of fused toner images on said first side of said web;

an application unit for applying a UV-curable coating composition on said fused toner images on said first side of said web;

a UV transparent film releasably contacting said first side of said web, wherein said coating composition is enclosed between said first side of said web and said UV transparent film in a contact zone; and a UV curing unit for irradiating said coating composition in said contact zone through said UV transparent film while said web is conveyed through said contact zone substantially simultaneously with said UV transparent film.

14. The apparatus of claim 13, wherein the thickness of said UV transparent film is in the range from about 1–250 microns.

15. The apparatus of claim 13, wherein said UV transparent film has a thickness of at least 40 microns.

16. The apparatus of claim 13, wherein said UV transparent film has a thickness of about 100 microns.

17. The apparatus of claim 13, wherein the UV transparent film has a thickness of between about 40 microns and about 100 microns.

18. The apparatus of claim 13, wherein said UV transparent film is a material selected from the group consisting of polyesters, polyethylene, polypropylene, cellophane and polyethylene terephtalate.

19. The apparatus of claim 13, wherein said digital printing unit is a single pass duplex printing unit.

20. The apparatus of claim 13, further comprising a rewinding unit for rewinding said UV transparent film.

21. The apparatus of claim 13, further comprising a slicing unit for slicing said web.

22. A method of forming a succession of images on a web comprising:

feeding a web through a digital printing unit to thereby form a succession of fused toner images on a first side of said web;

applying a UV-curable coating composition on said first side of said web carrying said fused toner images;

releasably contacting said first side of said web with a UV transparent film wherein said UV-curable coating composition is enclosed between said UV transparent film and said first side of said web in a contact zone; and curing said UV-curable coating composition by UV-irradiating said UV-curable coating composition through said UV transparent film in said contact zone.

23. The method of claim 22, wherein the curing is followed by disengaging said UV transparent film from said web.

24. The method of claim 22, wherein fused toner images are also formed on a second side of said web.

25. The method of claim 22, wherein prior to applying the coating composition, said first side of said web comprises an amount of release agent corresponding to 0.1 mg of release agent per printed side A4 or less.

26. A photograph multiple created by the process of forming a succession of images on a web comprising:

feeding a web through a digital printing unit to thereby form a succession of fused toner images on a first side of said web;

applying a UV-curable coating composition on said first side of said web carrying said fused toner images;

releasably contacting said first side of said web with a UV transparent film wherein said UV-curable coating composition is enclosed between said UV transparent film and said first side of said web in a contact zone; and curing said UV-curable coating composition by UV-irradiating said UV-curable coating composition through said UV transparent film in said contact zone.

27. The photograph of claim 26, wherein the curing is followed by disengaging said UV transparent film from said web.

28. The photograph of claim 26, wherein fused toner images are also formed on a second side of said web.

29. The photograph of claim 26, wherein prior to applying the coating composition, said first side of said web comprises an amount of release agent corresponding to 0.1 mg of release agent per printed side A4 or less.

30. A method of forming a succession of images on a web comprising:

feeding a web through a digital printing unit to thereby form a succession of fused toner images on a first side of said web;

applying a UV-curable coating composition on said first side of said web carrying said fused toner images;

contacting said first side of said web with a UV transparent film in a contact zone, such that in said contact zone said UV-curable coating composition is enclosed between said UV transparent film and said first side of said web; and curing said UV-curable coating composition by UV-irradiating said UV-curable coating composition through said UV transparent film in said contact zone, wherein the curing is followed by disengaging said UV transparent film from said web.

31. A photograph created by the process of forming a succession of images on a web comprising:

feeding a web through a digital printing unit to thereby form a succession of fused toner images on a first side of said web;

applying a UV-curable coating composition on said first side of said web carrying said fused toner images;

contacting said first side of said web with a UV transparent film in a contact zone, such that in said contact zone said UV-curable coating composition is enclosed between said UV transparent film and said first side of said web; and curing said UV-curable coating composition by UV-irradiating said UV-curable coating composition through said UV transparent film in said contact zone, wherein the curing is followed by disengaging said UV transparent film from said web.

* * * * *

UNITED STATES PATENT AND TRADEMARK OFFICE

CERTIFICATE OF CORRECTION

PATENT NO. : 6,880,463 B2
DATED : April 19, 2005
INVENTOR(S) : De Meulemeester et al.

It is certified that error appears in the above-identified patent and that said Letters Patent is hereby corrected as shown below:

Column 13,
Line 32, after "a UV transparent film" insert -- , --.
Line 48, after "photograph" delete "multiple".

Column 14,
Line 2, after "a UV transparent film" insert -- , --.

Signed and Sealed this

Twenty-ninth Day of November, 2005

JON W. DUDAS
*Director of the United States Patent and Trademark Office*